United States Patent [19]

Haliotis

[11] Patent Number: 4,725,352

[45] Date of Patent: Feb. 16, 1988

[54] SKIMMER-VACUUM REGULATOR FOR SWIMMING POOL

[76] Inventor: Peter D. Haliotis, 9610 N. 33 Ave., Phoenix, Ariz. 85051

[21] Appl. No.: 942,248

[22] Filed: Dec. 15, 1986

[51] Int. Cl.[4] ..... E04H 3/20

[52] U.S. Cl. ..... 210/169; 210/416.2; 137/625.3

[58] Field of Search ..... 210/169, 416.2, 232, 210/235; 4/490, 488; 15/1.7; 134/167 R; 137/625.3

[56] References Cited

U.S. PATENT DOCUMENTS

| | | | |
|---|---|---|---|
| 2,579,304 | 12/1951 | Crawford | 210/169 |
| 2,980,256 | 4/1961 | Nash | 210/169 |
| 3,000,508 | 12/1961 | Spaulding et al. | 210/169 |
| 3,252,576 | 12/1961 | Miller | 210/169 |
| 3,306,448 | 2/1967 | Baker | 210/169 |
| 3,443,264 | 11/1966 | Miller | 210/169 |
| 3,481,470 | 12/1969 | Valois | 210/169 |
| 3,567,020 | 3/1971 | Whitaker | 210/169 |
| 3,765,534 | 10/1973 | West et al. | 210/169 |
| 4,109,683 | 8/1978 | Strache | 137/625.3 |
| 4,126,925 | 11/1978 | Jacuzzi | 4/490 |
| 4,154,679 | 5/1979 | Farage | 210/169 |
| 4,375,821 | 3/1983 | Nanao | 137/625.3 |
| 4,480,662 | 11/1984 | Garrels | 137/625.3 |

FOREIGN PATENT DOCUMENTS

| | | | |
|---|---|---|---|
| 957620 | 11/1974 | Canada | 210/169 |

*Primary Examiner*—Peter Hruskoci
*Assistant Examiner*—Coreen Y. Lee
*Attorney, Agent, or Firm*—Nissle & Leeds

[57] ABSTRACT

An improved vacuum-skimmer regulator assembly for a swimming pool skimmer well. The regulator assembly permits a pool to be simultaneously skimmed and vacuumed and prevents leaves and other surfaces debris collected during skimming from interfering with the vacuuming process. The regulator apparatus also compensates for back pressure which may temporarily develop and, in conventional vacuuming apparatus, "blow" the vaccum hose from its connection with the conventional apparatus.

2 Claims, 3 Drawing Figures

SKIMMER-VACUUM REGULATOR FOR SWIMMING POOL

This invention relates to swimming pool skimming and vacuuming apparatus.

More particularly, the invention pertains to apparatus which, while permitting the simultaneous vacuuming and skimming of a swimming pool, prevents leaves and other surface debris collected during skimming from reducing the suction in a swimming pool vacuum hose and from otherwise interfering with the vacuuming process.

In another respect, the invention pertains to swimming pool vacuum--skimmer regulator apparatus which compensates for the temporary development of back pressure in the conduit leading from the skimmer well to the pool pump and which, consequently, prevents a pool vacuum hose from being "blown" from the regulator apparatus by such back pressure.

Present day conventional skimmmer--vacuum apparatus for swimming pools is in many respects similar to the apparatus described in U.S. Pat. No. 3,443,264 to Miller. The Miller apparatus is not designed to permit the vacuuming and skimming of a pool to occur simultaneously. While valve plate 51 in the Miller apparatus could conceivably be slightly opened to permit skimming to occur while a pool is being vacuumed, such opening of valve plate 51 ordinarily is avoided because it tends to destroy the suction in the interior of container 25 and, as a result, to prevent water from being drawn through hose 47 to the container. Further, since aperture 50 is a relatively small opening, it readily clogs with leaves and other surface debris. Any leaves and debris drawn through aperture 50 into strainer basket 31 impede the flow of water through strainer 31 and reduce the suction on water in hose 47 of the Miller apparatus.

As those with experience in vacuuming swimming pools in the desert southwest of the United States are aware, when a pool is properly maintained on a day-to-day basis, it is unusual for any quantity of leaves to accumulate on the bottom of the pool. Leaves falling on the surface of the pool are usually removed by the skimmer and never reach the bottom of the pool. If, however, the leaves are allowed to float on the surface of the pool for a length of time, the leaves become waterlogged, sink, and must be removed by vacuuming the pool. Maintaining skimming during vacuuming therefore minimizes the amount of leaves or other debris which becomes waterlogged and sinks to the bottom of the pool. Most swimming pools include a primary filter basket in the skimmer well and include another secondary filter basket located in the line leading from the skimmer well to the pool pump. If two separate streams of debris laden water can be simultaneously but independently drawn through the skimmer filter basket and secondary filter basket, respectively, then the amount of debris required to clog and render the water circulation system of the pool inoperable will normally be greater than if a single stream of debris laden water is sequentially drawn first through the skimmer filter basket and then through the secondary filter basket. Finally, a particularly important drawback of the apparatus of U.S. Pat. No. 3,443,264 is that back pressure which sometimes develops during operation of the pool pump can force cover 40 off of container 45, destroying the suction drawing water from hose 47 into container 45.

Accordingly, it would be highly desirable to provide an improved swimming pool skimmer—vacuum regulator assembly which would permit a pool to be simultaneously skimmed and vacuumed such that the stream of debris-laden water drawn into the vacuum would not pass through the skimmer basket but would instead pass through the secondary filter basket intermediate the skimmer well and pool pump.

Therefore, it is an object of the invention to provide an improved swimming pool skimmer—vacuum regulator assembly.

Another object of the invention is to provide an improved swimming pool skimmer—vacuum regulator assembly which permits a pool to be simultaneously vacuumed and skimmed without leaves and debris collected in the apparatus interfering with vacuuming of the pool.

A further object of the invention is to provide an improved swimming pool skimmer—vacuum regulator assembly which permits a pool to be simultaneously vacuumed and skimmed such that two separate leaf and debris laden streams of water flow through the skimmer strainer basket and secondary pump strainer basket, respectively.

Still another object of the instant invention is to provide an improved swimming pool skimmer—vacuum regulator assembly of the type described which includes a skimmer strainer basket adapted to remain in position in the skimmer well when the pool either is or is not being vacuumed.

Yet another object of the invention is to provide an improved swimming pool skimmer—vacuum regulator apparatus which compensates for temporary occurrences of back pressure in the conduit leading from the skimmer well to the pool pump and which, as a result, generally prevents the vacuum hose from being blown free of the apparatus.

These and other, further and more specific objects and advantages of the invention will be apparent from the following detailed description thereof, taken in conjunction with the drawings, in which.

Briefly, in accordance with the invention, I provide an improved skimmer—vacuum regulator assembly for use in a swimming pool skimmer well. The skimmer well includes a vertical wall and a bottom section defining a cavity, an exit port in either the vertical wall or bottom section and connected to a pump for withdrawing water from the skimmer well; and, structure defining a skimming inlet in communication with the cavity for receiving water from the water line of a pool. The skimmer—vacuum regulator assembly is placed in the cavity to permit a pool to be simultaneously vacuumed and skimmed such that the flow of water through a pool vacuum hose connected to the device is not affected by leaves and other debris skimmed into and trapped in the assembly. The regulator assembly comprises a filter basket disposed in the well in position normally below the water line and including a generally upright perforate side wall structure defining a basket opening, and a perforate bottom attached to the side wall structure; vacuum hose receiving means in the bottom of the filter basket including first conduit means extending upwardly from the bottom of the filter basket for removably sealingly receiving in fluid communication a vacuum hose used in vacuuming a swimming pool, the first conduit normally being below the water line of the pool, and second conduit means in fluid communication with the first conduit means and extending downwardly from the bottom of the filter basket; third conduit means inter-connecting in fluid communication said second conduit means and said exit port; and, skimmer13 water flow—regulating aperture means in at least one of the second and third conduit means. The skimmer—water flow—regulating aperture means in the second or third conduit means permits water to be drawn through the basket, the aperture means, and the exit port to the pump when a vacuum hose is attached to the first conduit means and when water flowing into the skimmer well from the pool water line cannot flow into the first conduit means. The improved skimmer—vacuum regulator assembly permits the simultaneous vacuuming and skimming of a pool and generally prevents leaves and other water line debris collected in the filter basket during skimmer from lodging in and blocking the skimmer—water flow—regulating aperture means, and prevents the temporary development of back pressure in the second and third conduit means and exit port from breaking the seal between the vacuum hose and first conduit means.

Figure 1:
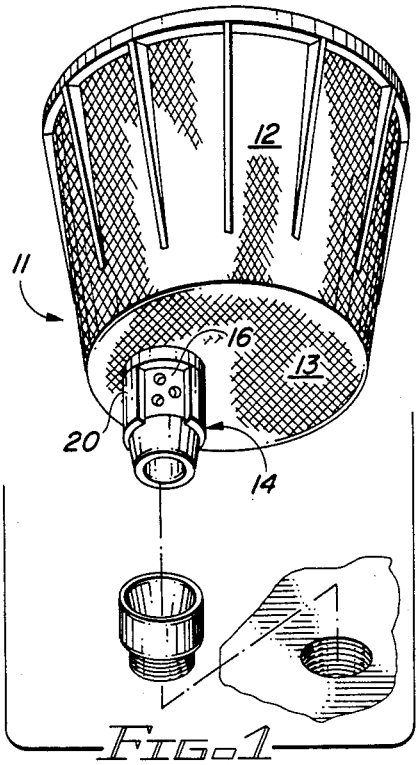
FIG. 1 is a perspective view illustrating apparatus constructed in accordance with the principles of the invention.
Figure 3:
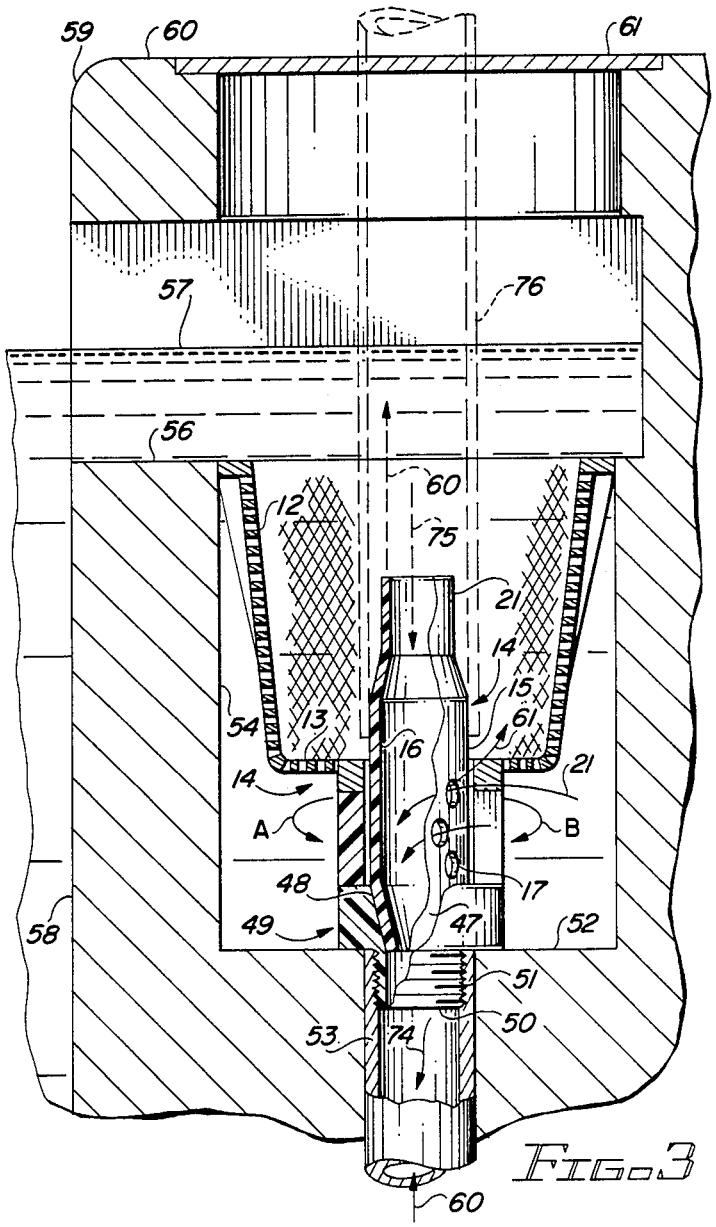
Figure 2:
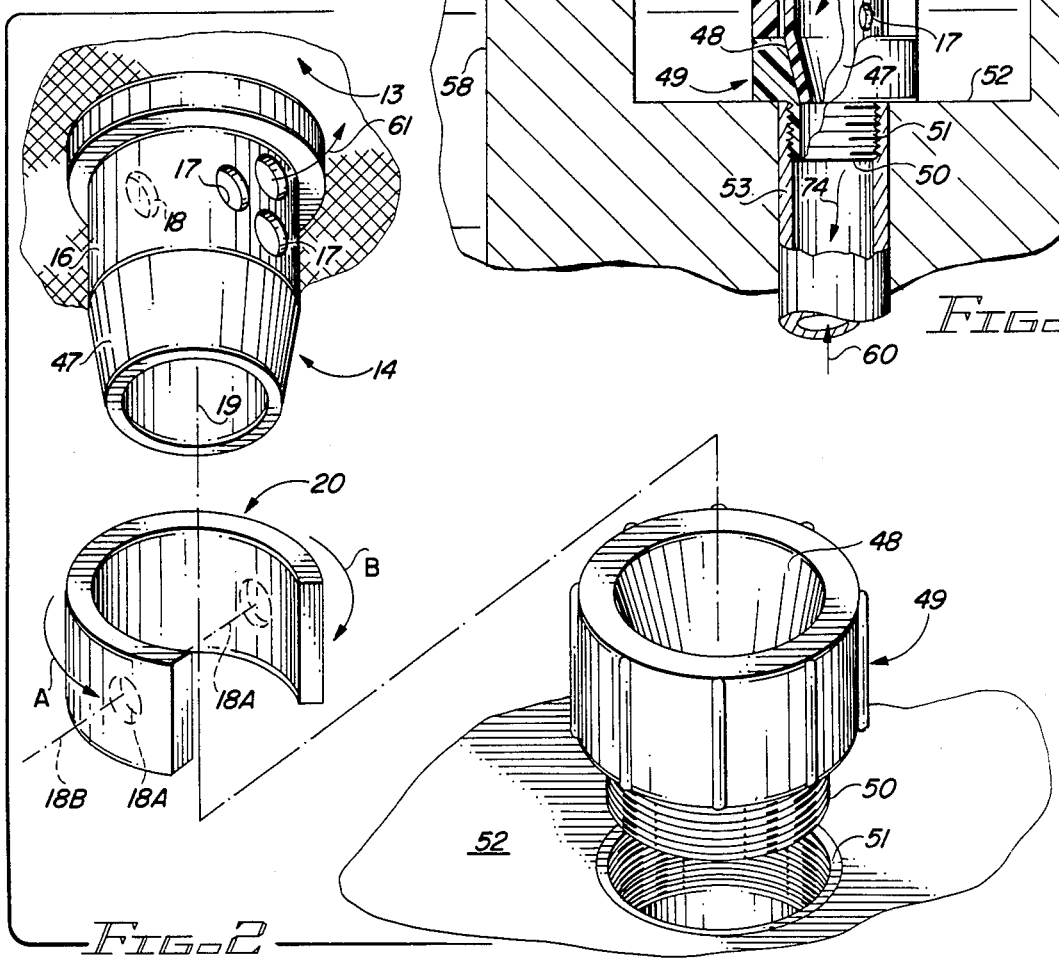
FIG. 2 is an exploded assembly view of a portion of the swimming pool skimmer—vacuum regulator apparatus of FIG. 1 further illustrating construction details thereof; and, FIG. 3 is a side elevation partial section view illustrating the swimming pool skimmer—vacuum regulator apparatus of FIG. 1 installed in a swimming pool skimmer well.

Turning now to the drawings, which depict the presently preferred embodiments and best mode of the invention for the purpose of illustrating the practice thereof and not by way of limitation of the scope of the invention and in which like reference characters indicate corresponding elements throughout the several views, FIGS. 1–3 illustrate the presently preferred embodiment and best mode of the invention including skimmer strainer filter basket 11 with perforate side wall structure 12 and perforate bottom 13. Hose receiving means 14 mounted in bottom 13 includes first cylindrical conduit 15 extending upwardly from bottom 13. Cylindrical conduit 15 is sized to removably frictionally sealingly receive an end of a swimming pool vacuum hose 76 in the manner indicated in FIG. 3. The upper end 21 of conduit 15 is sized to removably frictionally sealingly receive a cylindrical pool vacuum hose having a smaller diameter than cylindrical hose 76. A cap (not shown) can be removably frictionally sealingly placed over end 21 to prevent water from flowing through conduit 15 when the pool is not being vacuumed. Second cylindrical conduit 16 is attached to conduit 15 and downwardly extends from bottom 13. Apertures 17 are formed through the wall of conduit 16.

The number and position of apertures 17 formed in conduit 16 can be varied as desired. A single aperture 18 can, for example, be formed in conduit 16. Another aperture (not visible) opposed to aperture 18 can be formed in the wall of conduit 16 such that both aperture 18 and the opposing aperture are centered on a line which passes through center axis 19 and is perpendicular to the wall of conduit 16. Sleeve 20 is rotatably mounted in conduit 16. Rotating sleeve 20 in the directions indicated by arrows A and B covers apertures 17 and varies the flow rate of water through the side wall structure 12 and bottom 13 of basket and into apertures 17. When sleeve 20 is rotatably adjusted to the position shown in FIG. 1, apertures 17 are completely exposed and the suctional forces created in conduits 16 and 53 by the pool pump draw water through wall structure 12 and bottom 13 into apertures 17 are the greatest. Rotating sleeve 20 in the direction of arrows A or B from the position of FIG. 1 to partially or completely cover apertures 17 reduces the flow rate of water 21 through bottom 13 into apertures 17. Tapered end 47 of conduit 16 is contoured to be slidably frictionally removably sealingly force fit into the inner conical channel 48 of cylindrical collar 49. Lower externally threaded end 50 is turned into internally threaded exit port 51 formed in the bottom 52 of a swimming pool skimmer well. Exit port 51 is connected to a swimming pool pump and filter (not shown) by conduit 53. Water flowing through conduit 53 to a swimming pool pump normally passes through a secondary strainer basket prior to reaching the pump and filter associated with the pump. The secondary strainer basket functions like basket 11 and removes the leaves and larger debris from the water. The skimmer well also includes vertical wall 55 and inlet 56. Inlet 56 receives water from the water line 57 of the swimming pool. The inner wall 58, coping 59, and cool deck 60 of the swimming pool are also shown in FIG. 3. Circular cover 61 is removed when a hose 76 is inserted through circular aperture 62 and force fit over conduit 15.

In use, the components illustrated in FIGS. 1 and 2 are assembled in a swimming pool skimmer well in the manner illustrated in FIG. 3. When the pool is not being vacuumed, a cap can be placed over end 21 and sleeve 20 adjusted to the position of FIG. 1 such that all water flowing through inlet 56 into the skimmer cavity generally travels through wall structure 12 and bottom 13 of basket 12 and into apertures 17. To vacuum the pool, cover 61 and the cap over end 21 are removed, and one end of hose 76 is slidably sealingly removably force fit over conduit 15 in the manner illustrated in FIG. 3. Basket 11 is lifted from the skimmer well and sleeve 20 is rotatably adjusted in the direction of arrows A or B to move sleeve 20 over the desired portion of apertures 17. Basket 11 is then returned to the skimmer well and end 47 is slidably sealingly removably force fit in channel 48 of collar 49. As long as at least a portion of one of apertures 17 is not covered by sleeve 20, the skimmer—vacuum regulator assembly of FIGS. 1–3 permits a pool to be simultaneously vacuumed and skimmed. During vacuuming water flows through hose 76 and conduits 15, 16 in the direction of arrows 74, 75. If at least one of the apertures 17 is not entirely covered by sleeve 20, water also flows 21 through structure 12 and bottom 13 into apertures 17. In the event basket 11 fills with leaves before or after vacuuming, vacuuming of the pool is not impeded because conduits 15, 16, 53 allow a direct flow of water from the pool vacuum hose 76 though basket 11 to the pool pump. The skimmer—vacuum regulator assembly of the invention does not require removal of the skimmer basket 11 while the pool is being vacuumed. When a pool is well maintained on a day-to-day basis, leaves will ordinarily be skimmed from the water line and be collected in skimmer basket 11 and not in the secondary strainer basket positioned along conduit 53 intermediate the skimmer well and pool pump. Consequently, having to remove the skimmer basket during vacuuming to clean leaves and other debris from the basket or to install the vacuum hose 76 is unnecessary and undesirable.

During the starting and stopping of a swimming pool pump and under other circumstances, back pressure can temporarily develop in conduits 15, 16, 53. This back pressure can be significant and forces water and/or air in the direction indicated by arrows 60 and 61 in FIGS. 2 and 3. As earlier noted, such back pressure can force the cover 40 or hose 47 off of container 25 of the apparatus of U.S. Pat. No. 3,443,264. The apparatus of the invention compensates for such back pressure by permitting it to flow and escape through apertures 17 in the direction of arrows 61.

Apertures 18A and 18B can be formed through the wall of sleeve 20 to facilitate the use of sleeve 20 to adjust the rate of flow of water through apertures 17 or aperture 18. Opposing apertures 18A and 18B are centered on a line which passes through axis 19 and is perpendicular to the wall of sleeve 20.

Having described my invention in such terms as to enable those skilled in the art to understand and practice it and having identified the presently preferred embodiments and best mode thereof, I claim:

1. In combination with a swimming pool skimmer well, said well including a vertical wall and a bottom section defining a cavity, an exit port in one of said vertical wall and bottom section connected to a pump for withdrawing water from said skimmer well, and structure defining a skimming inlet in communication with said cavity for receiving water from the water line of a pool, a skimmer—vacuum regulator assembly placed in said cavity to permit a pool to be simultaneously vacuumed and skimmed such that the flow of water through a pool vacuum hose connected to said assembly is not affected by leaves and other debris skimmed into and trapped in said assembly, said regulator assembly comprising (a) a filter basket disposed in said well in position normally below said water line and including (i) a generally upright perforate side wall structure defining a basket opening, and (ii) a perforate bottom attached to said side wall structure;

(b) vacuum hose receiving means in said bottom of said filter basket including (i) first conduit means extending upwardly from said bottom of said filter basket for removably sealingly receiving in fluid communication a vacuum hose used in vacumming a swimming pool, said first conduit normally being below the water line of the pool, and (ii) second conduit means in fluid communication with said first conduit means and extending downwardly from said bottom of said filter basket;

(c) third conduit means interconnecting and in fluid communication with said second conduit means and said exit port; and, (d) skimmer—water flow regulating—aperture means for permitting water to be drawn through said basket, through said skimmer—water flow regulating—aperture means, and through said exit port to said pump when a vacuum hose is attached to said first conduit means and when water flowing into said skimmer well from said pool water line cannot flow into said first conduit means, said skimmer—water flow regulating—aperture means including (i) at least one aperture formed in said second conduit means; and (ii) sleeve means rotatably mounted on said second conduit means to regulate the flow rate of water through said aperture, said sleeve means including at least one opening formed therethrough to permit water to flow through said opening and said aperture when said sleeve means is rotated in position said opening over said aperture;

said regulator assembly permitting the simultaneous vacuuming and skimming of a pool and generally preventing leaves and other water line debris collected in said filter basket during skimming from lodging in and blocking said skimmer—water flow regulating—aperture means, and the temporary development of back pressure in said second and third conduit means and exit port from breaking the seal between the vacuum hose and first conduit means.

2. The regulator assembly of claim 1, wherein said aperture is formed in said third conduit means and said sleeve means is rotatably mounted on said third conduit means to regulate the flow of water through said aperture.

* * * * *